US011006228B2

(12) United States Patent
Badih et al.

(10) Patent No.: US 11,006,228 B2
(45) Date of Patent: May 11, 2021

(54) IMPLANTABLE MICROPHONE FOR AN IMPLANTABLE EAR PROSTHESIS

(71) Applicants: Université d'Aix Marseille, Marseilles (FR); Assistance Publique des Hôpitaux de Marseille, Marseilles (FR); Institut Français des Sciences et Technologies des Transports, de l'Aménagement et des Réseaux, Marne la Vallée (FR)

(72) Inventors: Laurent Badih, Salon de Provence (FR); Arnaud Philippe Deveze, Marseilles (FR)

(73) Assignees: UNIVERSITE D'AIX MARSEILLE, Marseilles (FR); ASSISTANCE PUBLIQUE DES HÔPITAUX DE MARSEILLE, Marseilles (FR); INSTITUT FRANAIS DES SCIENCES ET TECHNOLOGIES DES TRANSPORTS, DE L'AMÉNAGEMENT ET DES RÉSEAUX, Marne la Vallée (FR)

( * ) Notice: Subject to any disclaimer, the term of this patent is extended or adjusted under 35 U.S.C. 154(b) by 205 days.

(21) Appl. No.: 16/064,020

(22) PCT Filed: Dec. 23, 2016

(86) PCT No.: PCT/EP2016/082602
§ 371 (c)(1),
(2) Date: Jun. 20, 2018

(87) PCT Pub. No.: WO2017/109200
PCT Pub. Date: Jun. 29, 2017

(65) Prior Publication Data

US 2018/0376262 A1 Dec. 27, 2018

(30) Foreign Application Priority Data

Dec. 24, 2015 (FR) ..... 1563344

(51) Int. Cl.
*H04R 25/00* (2006.01)

(52) U.S. Cl.
CPC ..... *H04R 25/606* (2013.01); *H04R 2225/67* (2013.01)

(58) Field of Classification Search
CPC ..... H04R 25/60–609; A61F 11/00–14
See application file for complete search history.

(56) References Cited

U.S. PATENT DOCUMENTS 5,897,417 A * 4/1999 Grey ..... A63H 33/062 446/125
6,325,755 B1 * 12/2001 Bushek ..... H04R 25/606 600/25

(Continued)

FOREIGN PATENT DOCUMENTS

WO WO 99/04600 A1 1/1999
WO WO 00/48426 A2 8/2000

(Continued)

OTHER PUBLICATIONS

International Search Report as issued in International Patent Application No. PCT/EP2016/082602, dated Mar. 16, 2017.

(Continued)

*Primary Examiner* — Catherine B Kuhlman
(74) *Attorney, Agent, or Firm* — Pillsbury Winthrop Shaw Pittman LLP

(57) ABSTRACT

An implantable microphone for a middle ear prosthesis, includes an attachment system for fixing to a fixation bone close to an individual's middle ear; a cylindrical holding sheath, the sheath to be fixed to the fixation bone by the attachment system and having a suitable shape for extending (Continued)

from the fixation bone towards the ear ossicles of the individual; a coupler including a rod and an end piece of a suitable shape for bringing into contact with a point of the ear ossicles of the individual in a reversible manner; a sensor for converting a mechanical signal into an electrical signal, the sensor being secured to the coupler, supported by the cylindrical holding sheath and placed substantially in the extension of the axis of the cylinder; and a translation system for translation of the coupler along the axis of the cylinder, the translation system being housed in the sheath.

10 Claims, 9 Drawing Sheets

(56) References Cited

U.S. PATENT DOCUMENTS 6,398,717 B1 * 6/2002 Leysieffer ..... H04R 25/606 600/25
6,482,144 B1 11/2002 Mueller
2002/0026091 A1 * 2/2002 Leysieffer ..... H04R 25/407 600/25
2003/0163021 A1 8/2003 Miller et al.
2004/0264725 A1 12/2004 Madsen et al.
2008/0293998 A1 11/2008 Andrews

FOREIGN PATENT DOCUMENTS

WO WO 2010/133704 A2 11/2010
WO WO-2010133704 A2 * 11/2010 ..... H04R 25/606

OTHER PUBLICATIONS

Channer, G. A., et al., "Middle Ear Implants: Historical and futuristic perspective," Journal of Otology, vol. 6, No. 2, Dec. 2011, XP055295891, 9 pages.
Devéze, A., et al., "Techniques to Improve the Efficiency of a Middle Ear Implant: Effect of Different Methods of Coupling to Ossicular Chain," Otology & Neurotology, vol. 34, No. 1, Jan. 2013, XP055296167, pp. 158-166.

* cited by examiner

IMPLANTABLE MICROPHONE FOR AN IMPLANTABLE EAR PROSTHESIS

CROSS-REFERENCE TO RELATED APPLICATIONS

This application is the U.S. National Stage of PCT/EP2016/082602, filed Dec. 23, 2016, which in turn claims priority to French patent application number 1563344 filed Dec. 24, 2015. The content of these applications are incorporated herein by reference in their entireties.

FIELD

The present invention relates to the field of auditory implants, and in particular devices intended to be implanted in the middle ear, the inner ear, or again bone conduction implants. More specifically, the device according to the invention is an implantable microphone for receiving natural acoustic vibrations.

STATE OF THE ART

The human ear, the chief organ of the sense of hearing, is often described as consisting of three parts, as illustrated in FIG. 1: the outer ear 2, the middle ear 3 and the inner ear 4.

In a human auditory system the sound waves captured by the outer ear, or more specifically by the auricular pavilion 1, are guided by the outer auditory canal as far as a membrane called the eardrum 11. The eardrum 11, which separates the outer ear 2 from the middle ear 3, is made to vibrate by the sound waves, and transmits its vibration to a system formed by three ossicles called the hammer, anvil and stirrup 9. This chain of ossicles transmits the signal to the organs which form the inner ear 4, in particular the cochlear 6. The organs forming the inner ear translate the signals into nerve stimuli transmitted by the auditory nerve 5 to the brain, and interpreted as sounds.

Dysfunction of one or more parts of the ear can cause hearing defects which can be more or less substantial, going as far as partial or total deafness.

The technology of auditory implants and ear prostheses has made substantial progress, and enables the great majority of cases of deafness to be resolved, whatever their cause: ageing, sickness or accidents.

More specifically, auditory implants are the most appropriate solution in the case of deafness caused by serious dysfunction of the structures of the middle ear 3 or of the inner ear 4. In general a complete auditory implant performs at least three functions:

- Reception of a surrounding sound signal;
- Conversion of the sound signal into an electric signal, and possibly processing of the electric signal, for example by filtering by frequency, or amplification of certain frequency ranges of the signal;
- Recreation of the electrical signal for the auditory system in the form of an electrical or mechanical stimulation of a part of the auditory system itself.

Reception of the acoustic signal, and conversion of it into an electrical signal, are performed by a microphone. The microphone is usually placed outside the body. The acoustic signal captured by the microphone is then transmitted in the form of an electrical signal to the part of the device implanted, for example, in the middle ear, which is then responsible for recreating the signal for the auditory system.

In addition, an energy source, for example battery, must be connected to the microphone to operate it. The microphone and its battery therefore remain outside the patient's body, which may make people reluctant to use them, for reasons of appearance, or alternatively due to uncomfortable situations, for example when water is present, or during sleep.

A solution to these problems is the development of completely implantable devices including a microphone which is itself implantable.

A known solution is proposed by the Cochlear Carina™ implant, which involves the use of a subcutaneous implantable microphone. Even if aesthetically very satisfactory, this solution has substantial disadvantages in terms of the difficulty of adjusting it, excessive sensitivity to bodily noises, and limitations of acoustic gain.

Other known solutions, such as the Esteem™ device of Envoy™ (FIG. 2), already use a microphone which is implantable in the middle ear 3, including a sensor, such as for example a piezoelectric transducer 200 coupled to one of the ossicles 210 of the middle ear. The role of this sensor is to translate the mechanical vibrations of the ossicles into an electrical signal. This signal will then be processed, and recreated for auditory implant 220, for example within the inner ear, in the form of an electric or vibrational stimulus. This device is a complete implant, since it enables vibrations to be recovered and then created for the auditory system. However, installing this system requires the ossicular chain to be broken, both to receive the acoustic vibrations and to recreate the signal for the inner ear.

In other words, it is necessary to break the ossicular chain to be able to install the implant and to make it operational. It is therefore difficult to reverse this implant since after it is withdrawn the auditory system cannot regain its original function.

The solutions currently proposed enabling microphones to be produced which can be implanted in the middle ear therefore pose two major difficulties:

- the implants are not reversible, since their installation involves the breakage of the chain of ossicles (see the example of FIG. 2);
- the coupling between the sensor and the chain of ossicles cannot be modified, which makes it impossible to improve the coupling, since the position of the implant relative to the ossicular chain is fixed, and cannot be modified to adapt to changes of this environment over time

Technical Problem

Against this background, the aim of the present invention is to propose an implantable microphone for a middle ear auditory implant, a bone conduction implant or a cochlear implant, where the said microphone has an adaptive coupling between the ossicular chain and the linear actuator.

SUMMARY OF THE INVENTION

To this end, the invention discloses an implantable microphone for a middle-ear ear prosthesis including:

- means designed to be attached to an attachment bone in proximity to an individual's middle ear;
- a cylindrical retaining sheath, where the said sheath is designed to be attached to the attachment bone using the said attachment means, and is shaped such that it extends from the attachment bone toward the individual's ossicular chain;

a coupler including a rod and an end-piece shaped such that it can be brought into contact with at least one point of the individual's ossicular chain in a reversible manner;

a sensor to convert a mechanical signal into an electrical signal, where the said sensor is secured to the coupler, supported by the cylindrical retaining sheath, and positioned substantially in alignment with the cylinders axis;

means to move the said coupler with linear motion along the cylinders axis, where the said means are contained in the cylindrical sheath.

The term "means designed to be attached to an attachment bone in proximity to an individual's middle ear" is understood to mean an attachment system formed, for example, by a support arm, where one end of the said arm is intended to receive an attachment screw and the other end is intended to support the cylindrical sheath.

The attachment screw used is, for example, an osteosynthesis screw. The term "osteosynthesis screw" is understood to mean a screw used, in a known manner, to install an implant, and in particular to attach the implant to a bone.

A bone in proximity to the ear is, for example, the mastoid bone.

The term "retaining cylindrical sheath" is understood to mean a hollow cylinder forming the outer casing of the device, which has a dual function:

to contain the means to move the sensor secured to the coupler with linear motion;

to keep the sensor, at once, attached to a bone in proximity to the ear, and in contact, via the coupler, with the individual's ossicular chain.

The term "coupler" is understood to mean a rod secured to an end-piece, where the said end-piece may have different shapes depending on the location of the ossicular chain with which it is intended to be brought into contact, and the desired type of contact. The shape of the end-piece is such that it can be positioned relative to the ossicular chain without altering the ossicular chain's shape or breaking it. This property makes the implant completely reversible: the patient's auditory system can be returned to the configuration it had before the implantable microphone was installed.

The shapes of the end-piece are chosen such that contact can be made by simple pressing or by clipping with at least one point of the ossicular chain.

The term "sensor" or "linear actuator" or "transducer" is understood to mean an element capable of translating a vibrational signal into an electrical signal. An example of a sensor is a piezoelectric, electromechanical or micro-membrane transducer.

The term "means to move the said coupler with linear motion along the cylinders axis" is understood to mean means enabling the coupler to be moved in linear fashion along the axis of the cylinder identified by the sheath. This linear motion enables the pressure exerted by the coupler on the chain of ossicles to be adjusted, and therefore the intensity of the coupling between the sensor and the ossicular chain to be modified. This adjustment enables the coupling to the ossicular chain to be modified, even after the microphone has been implanted, for example so as to modify it to adapt to anatomical changes of the patient's auditory system.

In general, the invention consists of a microphone which can be implanted in the middle ear to receive acoustic vibrations. This microphone includes a coupler, formed by a rod secured to an end-piece, where the said coupler is in contact with the patients ossicular chain. When an acoustic signal arrives in the individual's ear, eardrum 11 is made to vibrate. These vibrations are transmitted to the individual's ossicular chain consisting of three ossicles: the hammer, the anvil and the stirrup. The present invention exploits the movements of the bones to receive the acoustic vibrations. The coupler is in contact by simple pressure or by clipping with a location of the ossicular chain, which enables the mechanical energy of the vibrations to be transmitted to a sensor. The sensor can be, for example, a piezoelectric transducer, an electromechanical transducer or a transducer of the micro-membrane type. The sensor translates the mechanical signal received in this manner into an electrical signal.

A remarkable advantage of the device according to the invention is that the microphone is configured to be installed in a reversible manner. In other words, installation of the microphone does not require the individual's ossicular chain to be broken, and the patient's auditory system can be returned to the configuration it had before the implant was installed.

Another remarkable advantage of the device according to the invention is the possibility of adjusting the position of the coupler by translation along the axis of the cylinder. By modifying the position of the coupler the pressure exerted by the end-piece on the ossicular chain is adjusted. This adjustment enables improved control to be achieved of the coupling between the sensor or transducer or linear actuator and the ossicular chain, and the intensity of the coupling can be modified over time to adapt the coupling to anatomical changes of the patients auditory system.

The sensor, for example a piezoelectric transducer, an electromechanical transducer or a micro-membrane transducer, is secured to a moving part. The positioning part includes an unthreaded portion consisting of a position into which the sensor fits. The positioning part also includes a threaded portion into which a micrometric feed screw is inserted. The sensor is also secured to a coupler consisting of a rod secured to an end-piece. The shape of the end-piece varies depending on the location of the ossicular chain and the characteristics of the coupling which it is desired to produce. The end-piece can, for example, have the shape of a point, a ball, a three-pronged clamp or a two-pronged clamp.

In a known manner, the device is fitted with at least one grommet to ensure its connectivity.

In a known manner, the device is encapsulated in titanium in order to be able to be implanted. The microphone is connected to the implant's main body, which contains an energy source to operate the auditory prosthesis and the electronic components to process of the signal received by the microphone and to reproduce it for the patient's auditory system.

The device according to the invention may also have one or more of the characteristics below, considered individually, or in all technically possible combinations:

the said attachment means include at least one arm, where one end of the arm includes at least one position for an attachment screw, and where another end supports the cylindrical sheath;

the attachment screw is an osteosynthesis screw;

the said translation means include: a micrometric feed screw, a sliding ring, a positioning part, where the said sliding ring is a hollow cylinder concentric to the cylindrical retaining sheath;

the cylindrical sheath includes at least one pin and the sliding ring includes at least one recess shaped so as fit on the pin to prevent it rotating around the axis of the cylinder, and to prevent it moving along the axis of the cylinder, where the said micrometric screw is installed in the axis of the sliding ring, and prevented from rotating and from moving in linear fashion in the area of the face of the sliding ring close to the attachment bone;

the positioning part includes a unthreaded portion intended to receive the transducer, and a threaded portion, into which the micrometric feed screw is inserted;

the positioning part, the transducer and the coupler are rotationally secured around the axis of the cylinder, and translationally secured along the axis of the cylinder;

the linear motion of the coupler along the axis of the cylinder modifies the contact pressure of the said coupler on the ossicular chain;

the intensity of the coupling between the transducer and the ossicular chain is optimised by means of an in-ear impedance measurement;

the sensor is a piezoelectric transducer;

the sensor is an electromechanical transducer the sensor is a micro-membrane transducer;

the end-piece is spherical in shape;

the end-piece is shaped like a two-pronged clamp;

the end-piece is shaped like a three-pronged clamp;

it contains at least one grommet to ensure connectivity;

it is encapsulated in titanium;

it is connected to the implant's main body by a two- or three-point connector;

the outer surface of the sliding ring is substantially spherical in shape, and the cylindrical sheath has a cavity of substantially hemispherical shape, where the microphone also has a cylindrical locking ring with a female hemispherical end-piece.

Another object of the invention is a device including

A microphone according to the invention;

An implant including a main implant body;

A connector with two or three points, where the said microphone is connected to the said implant by the said two- or three-point connector.

Another object of the invention is a method for using the microphone according to the invention, where the said method includes a step of coupling between the sensor and the ossicular chain using an in-ear impedance measurement.

LIST OF FIGURES

Other characteristics and advantages of the invention will become clear from the description which is given of it below, by way of example and non-restrictively, with reference to the appended figures, in which.

Figure 4:
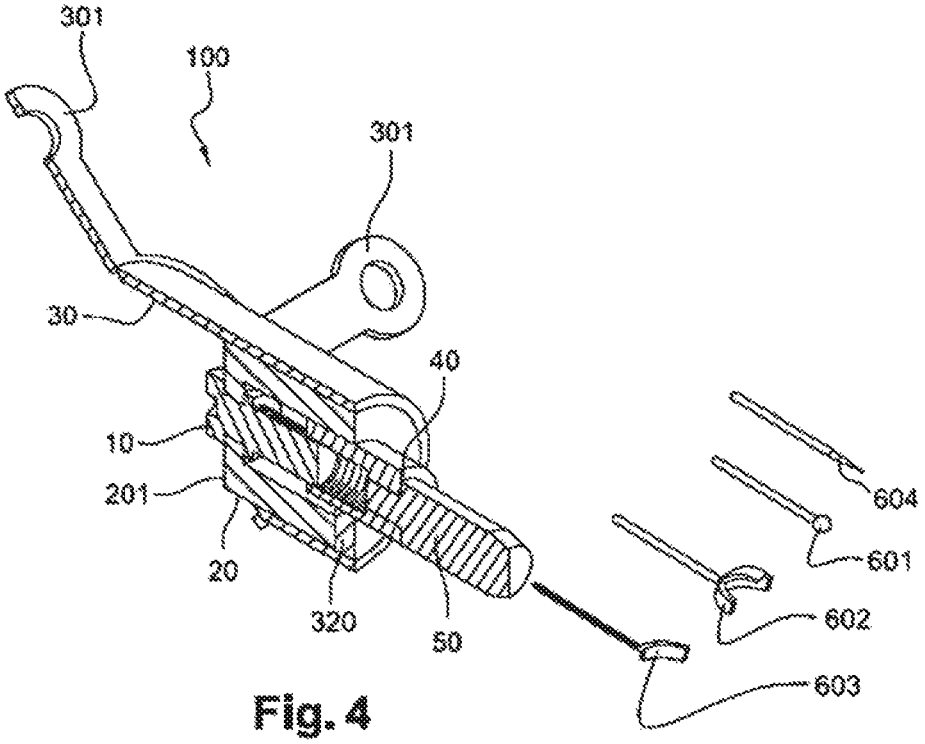
FIG. 4 shows a three-dimensional view of the device of FIG. 3.
Figure 5B:
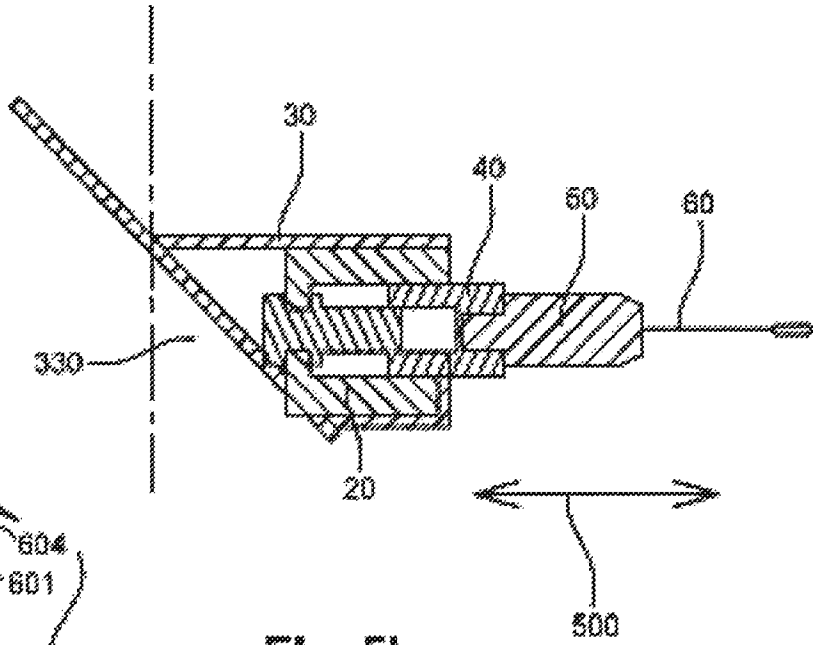
Figure 5A:
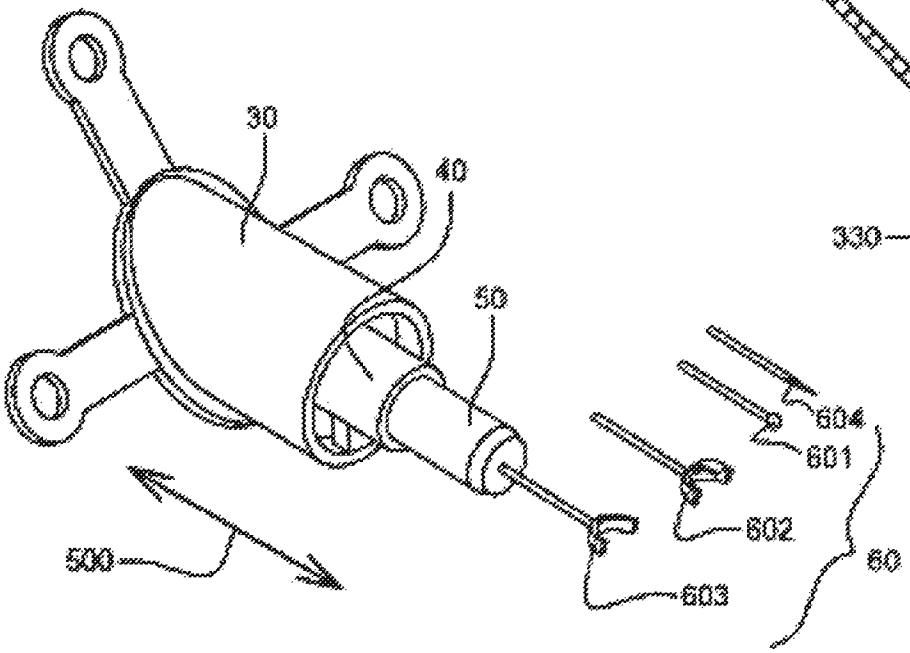

FIG. 5*a* shows a global view of the device of FIG. 4 after assembly, and FIG. 5*b* shows a section view of the device of FIG. 5*a;*

Figure 6B:
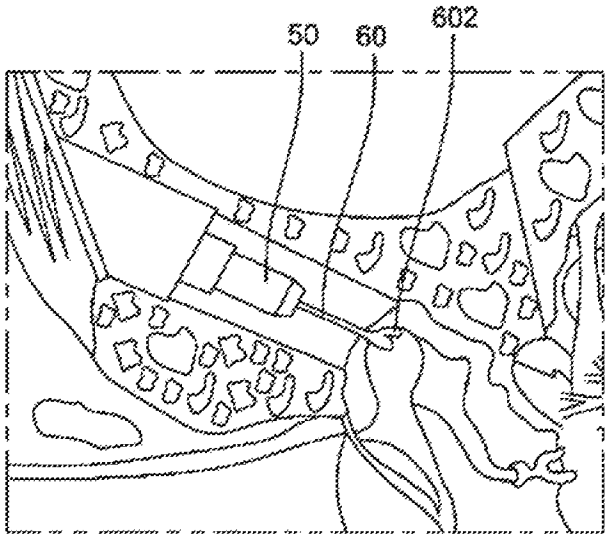
Figure 6A:
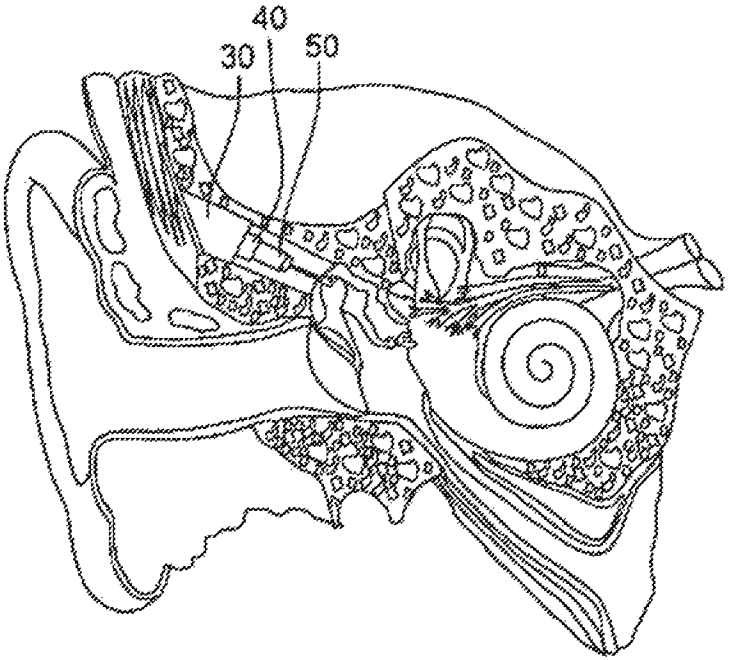
Figure 7B:
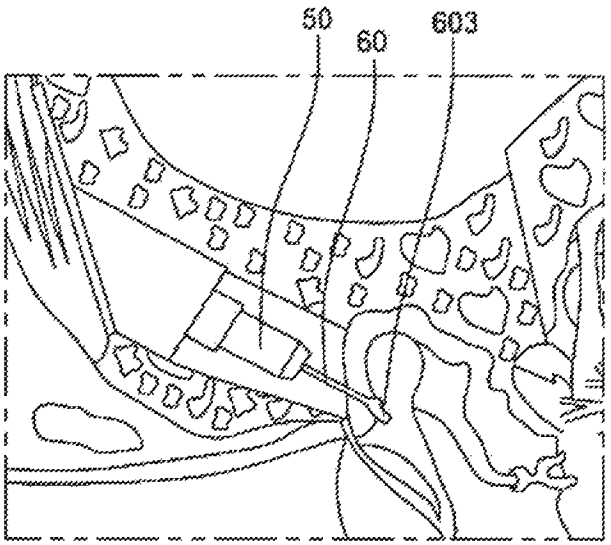
Figure 7A:
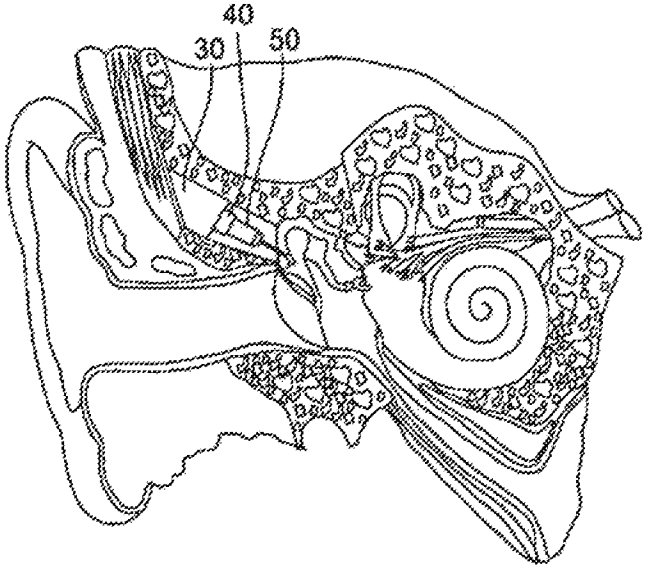
Figure 8B:
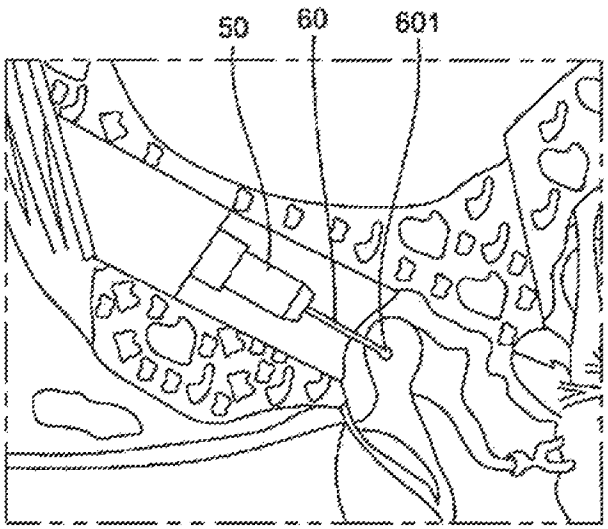
Figure 8A:
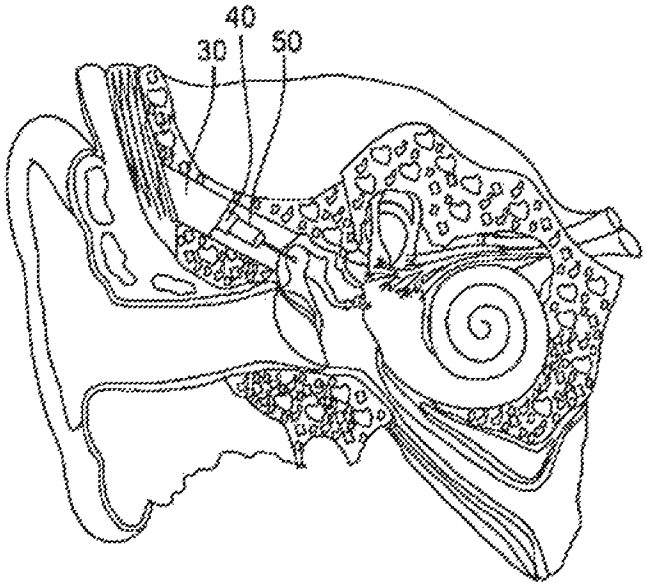

FIG. 6*a* shows one embodiment of the device of FIGS. 3, 4, 5*a* and 5*b* with an end-piece shaped like a three-pronged clamp making contact by clipping the head of the hammer;

FIG. 6*b* is an enlargement of a part of FIG. 6*a* showing in detail the end-piece shaped like a three-pronged clamp in contact with the head of the hammer;

FIG. 6*a* shows one embodiment of the device of FIGS. 3, 4, 5*a* and 5*b* with an end-piece shaped like a two-pronged clamp making contact by clipping the downward-pointing part of the hammer;

FIG. 7*b* is an enlargement of a region of FIG. 7*a* showing details of the end-piece shaped like a two-pronged clamp, in contact with the downward-pointing part of the hammer;

FIG. 8*a* shows one embodiment of the device of FIGS. 3, 4, 5*a* and 5*b* with an end-piece shaped like a ball making a pressure contact with the head of the hammer.

FIG. 8*b* is an enlargement of portion of FIG. 8*a* showing details of the ball-shaped end-piece in contact with the head of the hammer.

Figure 9B:
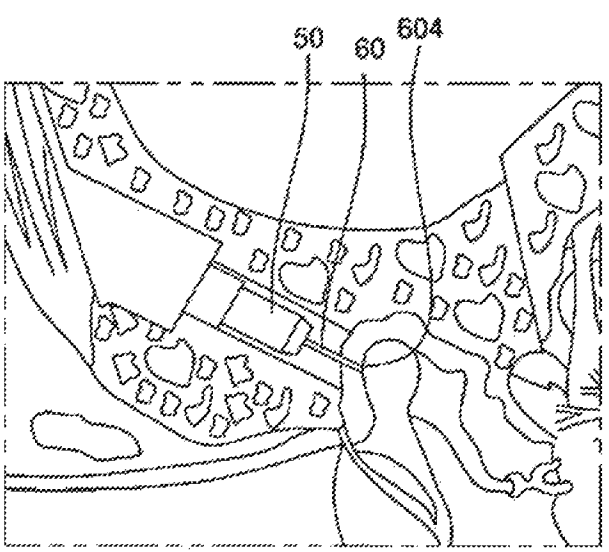
Figure 9A:
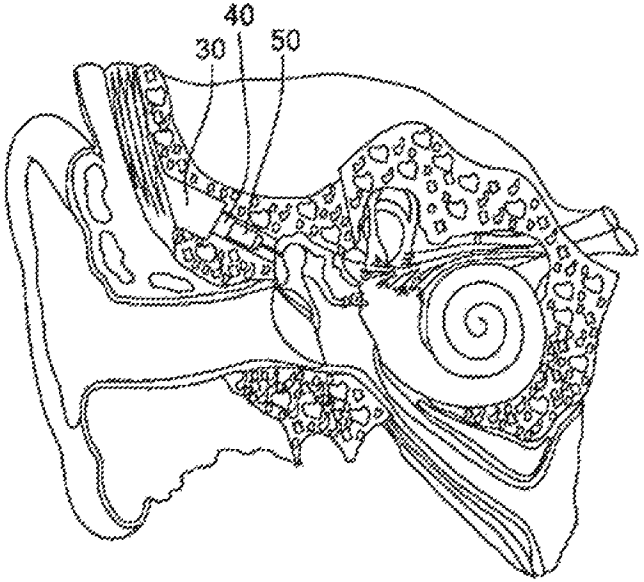

FIG. 9*a* shows one embodiment of the device of FIGS. 3, 4, 5*a* and 5*b* with a point-shaped end-piece making a pressure contact with the head of the hammer. FIG. 9*b* shows an enlargement of portion of FIG. 9*a* showing details of the point-shaped end-piece in contact with the head of the hammer.

Figure 10:
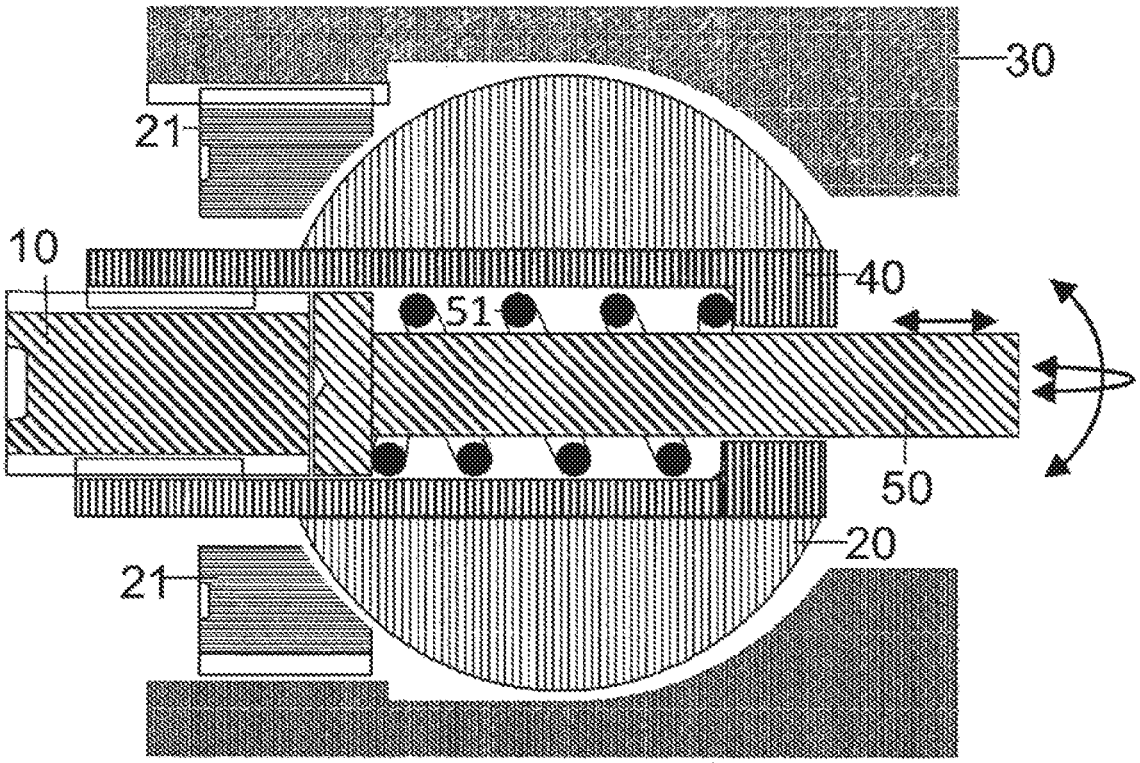
Figure 11A:
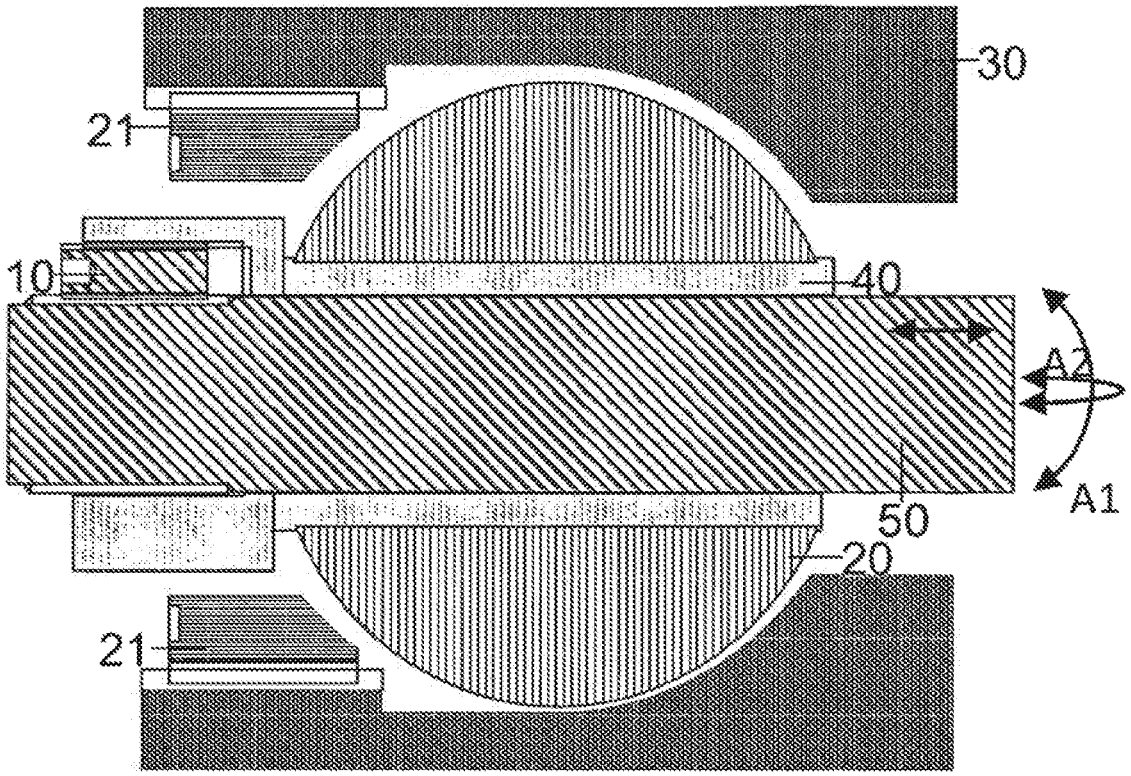

FIG. 10 shows a section view of an embodiment of the device according to the invention; this embodiment allows the device to be positioned in three dimensions relative to the ossicular chain;

FIG. 11*a* shows a section view of one embodiment of the device according to the embodiment; this embodiment allows the device to be positioned in three dimensions relative to the ossicular chain;

FIG. 11 *b* shows an enlargement of the feed screw represented in FIG. 11*a;*

DETAILED DESCRIPTION

Figure 1:
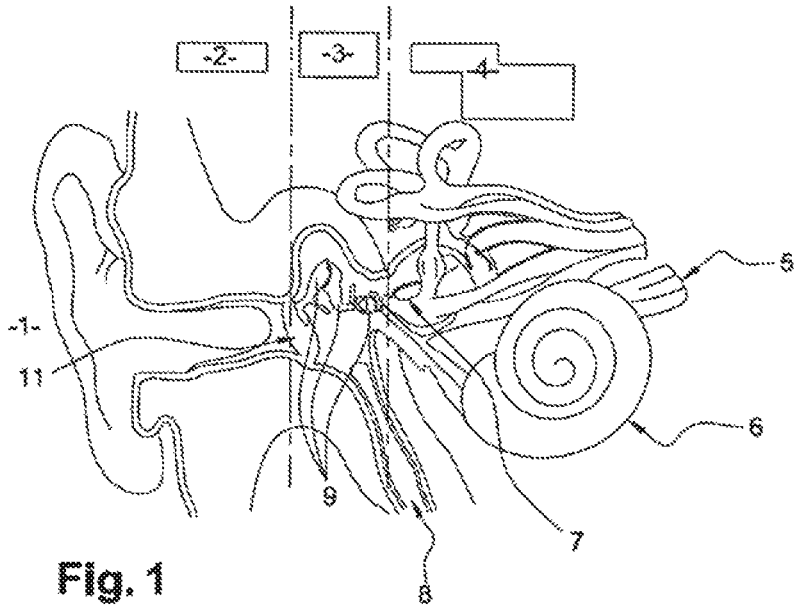
FIG. 1 represents the structure of the human auditory system.
Figure 2:
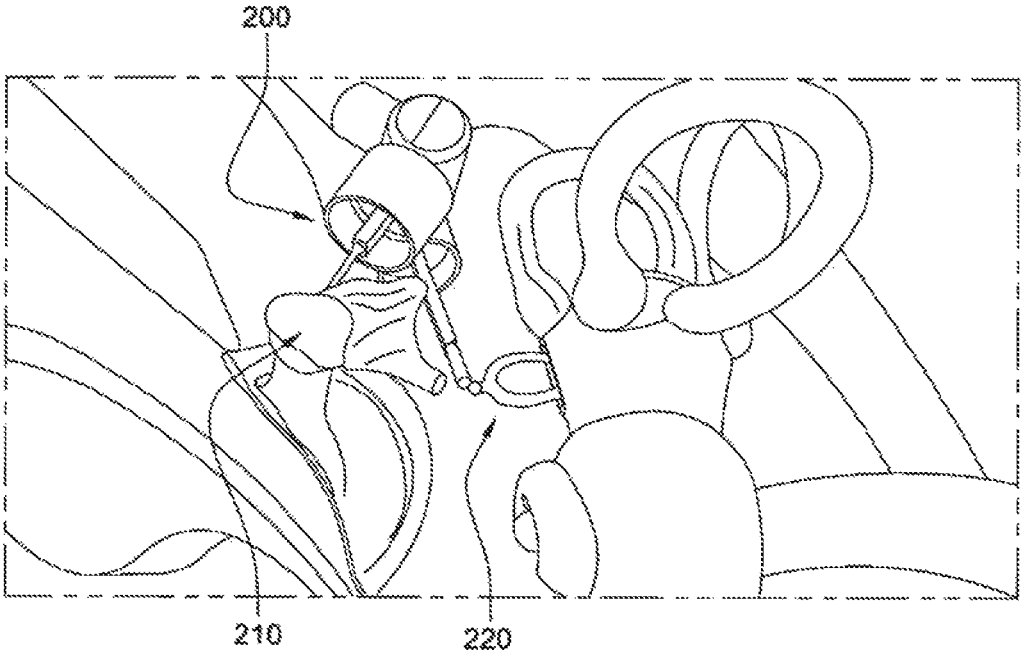
FIG. 2 represents the Esteem™ device of Envoy™ according to the prior art.
Figure 3:
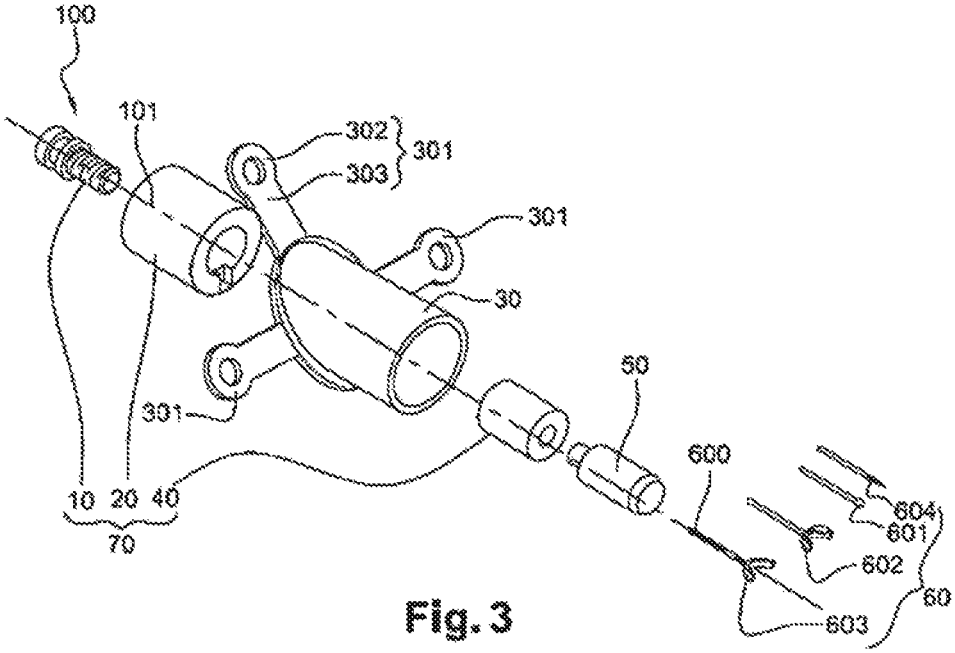
FIG. 3 shows a global exploded view of the device according to the invention.

FIG. 3 shows a global exploded view of device 100 according to the invention.

Device 100 according to the invention includes:

a cylindrical retaining sheath 30; the axis of the cylinder identified by sheath 30 is axis 101;

attachment means 301 designed to be attached to a bone in proximity to an individual's middle ear, where said means 301 include at least one position 302 for an attachment screw and an arm 303;

a coupler 60 comprising a rod 600 and end-piece of variable shape 601, 602, 603 or 604, where rod 600 is installed in axis 101, and where said coupler 60 is intended to be brought into contact with a location of the ossicular chain;

means 70 for imparting linear motion to coupler 60 comprising:

a cylindrical sliding ring 20 positioned in axis 101 and held inside sheath 30, where said ring 20 is rotationally and translationally secured to cylindrical sheath 30;

a micrometric feed screw 10 installed in axis 101 and translationally and rotationally secured to ring 20 and sheath 30; the head of screw 10 is attached in the area of face 201 of sliding ring 20;

a positioning part 40 of cylindrical shape, installed in axis 101; the part contains an unthreaded portion and a threaded portion, where the threaded portion is intended to be screwed on to screw 10;

a sensor 50 of cylindrical shape, positioned in axis 101, where the said sensor is designed to be fitted into the unthreaded portion of part 40 and is secured to coupler 60.

FIG. 4 shows a three-dimensional and section view of device 100 of FIG. 3.

Means 301 are the means for attaching the microphone to a bone in proximity to the ear.

According to one embodiment of the invention the said attachment means 301 include at least one arm 303, where one end of the arm includes at least one position 302 for an attachment screw, and where another end supports cylindrical sheath 30.

A plurality of means 301 with this function can be present, for example the device according to FIG. 3 shows three attachment arms 303.

One advantage of this embodiment is that the implant can be attached in a stable manner in proximity to the location of the ossicular chain of interest.

Advantageously, each arm 303 can have several positions 302, by this means improving the device's attachment to the bone, in particular the mastoid bone.

According to a first embodiment of the invention, means 70 for imparting linear motion to coupler 60 include a micrometric feed screw 10, a sliding ring 20 and a positioning part 40, where said sliding ring 20 is a hollow cylinder concentric to cylindrical retaining sheath 30.

One advantage of this embodiment is that it allows linear motion to be imparted to coupler 60 in a manner which is simple for the operator, whilst continuing to ensure satisfactory positional accuracy, due to the presence of micrometric screw 10. As it is screwed on micrometric screw 10 positioning part 40 can move forward or backwards along axis 101 of cylinder 30, thereby bringing it closer to the ossicular chain, or moving it away from it.

Cylindrical sheath 30 therefore has a dual function: to hold in place the system formed by sensor 50 secured to coupler 60, and to hold means 20, 10, 40 for imparting linear motion to coupler 60.

Cylindrical sheath 30 advantageously includes a pin 320 and sliding ring 20 includes a recess (not shown in the figure) shaped so as to fit on the pin to prevent it rotating around the axis of the cylinder and from linear motion along axis 101 of the cylinder, where said micrometric screw 10 is positioned along the axis of sliding ring 20 and prevented from rotating and from moving in linear fashion in the area of the face of sliding ring 201 in proximity to the attachment bone.

Sliding ring 20 is thus secured to cylindrical retaining sheath 30 both rotationally and translationally. Sliding ring 20 and retaining sheath 30 are configured as two concentric cylinders with identical axis 101. Face 201 of the sliding ring in proximity to the attachment bone includes a recess for the head of micrometric screw 10. Said micrometric screw 10 is therefore positioned parallel to the axis of cylinder 101 and prevented from rotating and from moving in linear fashion.

One advantage of this arrangement is that sheath 30, sliding ring 20 and micrometric screw 10 are rotationally and translationally secured to one another. Since cylindrical sheath 30 is attached to a bone, sliding ring 20 and the micrometric screw are themselves fixed in position. Positioning part 40 can therefore be screwed on to positioning screw 10, causing the positioning part to move in linear fashion relative to cylindrical sheath 30. As it moves along axis 101 of the cylinder, positioning part 40 slides inside ring 20 and can therefore be brought closer to or moved away from sensor 50 (secured to part 40) of the ossicular chain.

Another advantage of this arrangement is that it gives the implant stability, and in particular sensor 50, meaning that the mechanical vibrations of the chain of ossicles can be received more effectively.

According to one variant, positioning part 40 contains an unthreaded portion intended to receive sensor 50 and a threaded portion into which micrometric feed screw 10 is inserted.

One advantage of this variant is that sensor 50 is attached to positioning part 40 by placing it in the unthreaded portion of positioning part 40. Since said positioning part 40 can move in linear fashion relative to sheath 30 and slide inside ring 20, it enables sensor 50 to be moved in linear fashion using micrometric feed screw 10. By moving along the axis of cylinder 101 the sensor can therefore be brought closer to or moved away from the ossicular chain.

According to another variant, positioning part 40, sensor 50 and coupler 60 are translationally secured to one another, along axis 101 of cylinder 30.

One advantage of this other variant is that it enables the system formed by positioning part 40, sensor 50 and coupler 60 to be moved in linear fashion simply by screwing positioning part 40 on micrometric feed screw 10. This linear motion enables the position of said coupler 60 to be changed, and therefore for it to be brought closer to or moved away from the individual's ossicular chain.

Parts 10, 20 and 40 form means 70 for imparting linear motion to sensor 50 secured to coupler 60. More accurately, by screwing the threaded portion of positioning part 40 of the sensor on the micrometric feed screw secured linear motion of the system comprising the sensor 50, its positioning part 40 and coupler 60 is obtained.

The linear motion of coupler 60 modifies the contact pressure of said coupler 60 on the ossicular chain.

This translational adjustment enables to the intensity of the coupling between sensor 50 and the chain of ossicles to be changed. This enables to the implant to be adapted to changes of the patient's auditory system over time, for example to take account of anatomical changes.

Another advantage of the adjustable position of coupler 60 is that the optimal coupling to the ossicular chain can be sought by means of an in-ear impedance measurement. The term "optimal coupling of sensor 50 to the ossicular chain" is understood to mean a coupling such that the mechanical vibrations are effectively transmitted to sensor 50 without however altering the mechanical properties of the chain of ossicles. Indeed, the ossicular chain is intended to vibrate as the vibrations are received from eardrum 11. This vibration can be prevented when an object such as coupler 60 of the microphone presses on one of the ossicles. For example, the response of the ossicular chain can be altered for certain frequency ranges. To prevent this contact preventing the ossicles of the chain from vibrating correctly the optimal contact pressure can be determined by making an in-ear impedance measurement. This measurement enables a check to be made whether the quality of transmission of the vibrations at the various frequencies is altered by the presence of coupler 60. If excessive alteration is observed the position of coupler 60 can be changed until the optimal coupling is obtained.

Sensor 50 can be a piezoelectric transducer.

Sensor 50 can also be an electromechanical transducer.

Sensor 50 can also be a sensor of the micro-membrane type.

One advantage of this type of sensor is the use of a transducer 50 to convert from a mechanical signal into an electrical signal. All electromechanical transducers able to translate a mechanical signal into an electrical signal can be used.

According to one preferred embodiment, the coupler contains a rod 60 secured to an end-piece (601, 602, 603 or 604), where the said end-piece makes the contact between coupler 60 and the individual's ossicular chain.

One advantage of this preferred embodiment is that the contact between the individual's ossicular chain and sensor 50 is ensured through the presence of the end-piece at the end of coupler 60.

According to a first embodiment the end-piece is spherical in shape 601.

One advantage of this first embodiment is that microphone 100 can be coupled to the individual's ossicular chain by simple contact pressure. The fact that the structure of the ossicles is not altered makes the implant completely reversible. In addition, this shape of end-piece enables the end-piece to be moved in linear fashion without detaching it from the ossicular chain.

According to a second embodiment, end-piece 60 is shaped like a two-pronged clamp 603.

One advantage of this second embodiment is that microphone 100 can be coupled to the individual's ossicular chain by clipping to the ham. The fact that the structure of the ossicles is not altered makes the implant completely reversible.

According to a third embodiment, the end-piece is shaped like a three-pronged clamp 602.

One advantage of this third embodiment is that microphone 100 can be coupled to the individual's ossicular chain by clipping to the head of the hammer. The fact that the structure of the ossicles is not altered makes the implant completely reversible.

According to a fourth embodiment, the end-piece is shaped like a point 604.

One advantage of this fourth embodiment is that microphone 100 can be coupled to the individual's ossicular chain by simple contact pressure. The fact that the structure of the ossicles is not altered makes the implant completely reversible. In addition, this shape of end-piece enables the end-piece to be moved in linear fashion without detaching it from the ossicular chain.

In general, being able to choose several shapes of end-piece provides great flexibility in adapting the device during implantation. It means that, concomitantly, the conformation of the individual's middle ear can be taken into account, and the optimal coupling between the ossicular chain and the sensor can be sought, due to the degree of translational freedom of the coupler.

According to a preferred embodiment, the microphone is connected to the implant's main body by a two- or three-point connector. One advantage of this preferred embodiment is the possibility of replacing the implants main body—containing the battery to power the prosthesis and the electronics for processing the signal and stimulation—without removing the microphone, and therefore without modifying the coupling to the individual's ossicular chain.

FIG. 5*a* shows a global view of the device after being assembled. In this figure attachment means 301 can be seen, including at least one attachment hole for at least one osteosynthesis screw. The purpose of means 301 is to attach the microphone to a bone in proximity to the ear, for example the mastoid bone. In this figure see part 40, which positions captor 50 and coupler 60, can be seen, and also different shapes of end-piece 601, 602, 603 or 604 for the coupler. Elements 40, 50 and 60 are secured to one another, and can move with linear motion by screwing micrometric feed screw 10 into positioning part 40. The direction of linear movement is identified by double arrow 500 and follows axis 101 of cylindrical sheath 30. This adjustment enables the position of the coupler to be modified, and therefore the intensity of the coupling between the microphone and the ossicular chain to be modified.

Cylindrical retaining sheath 30 is secured to attachment system 301 and to the bone to which the microphone is attached. Sliding ring 20 and micrometric screw 10 are also secured to cylindrical sheath 30.

FIG. 5*b* shows another section view of the system. The face of the cylindrical sheath in contact with the attachment surface forms an angle 330 with axis 101 of the cylinder. The function of this rake angle can be understood in FIGS. 6, 7 and 8. Indeed, the angle enables the cylinder forming sheath 30 to be extended from the attachment bone toward the chain of ossicles in a direction which can bring the coupler into contact with the ossicular chain. The translational direction of the coupler to obtain optimal coupling is represented by double arrow 500.

FIGS. 6*a*, 6*b*, 7*a*, 7*b*, 8*a*, 8*b*, 9*a* and 9*b* show particular methods of use of the device according to the invention.

FIG. 6*a* shows a particular embodiment of the device according to the invention. The microphone is implanted in the middle ear. Cylindrical sheath 30 can be seen extending from the mastoid bone toward the chain of ossicles. Extending beyond the sheath, in the axis of the cylinder, positioning part 40 and sensor 50 can be seen. This figure also shows how rake angle 330 of cylinder 30 enables, concomitantly, the device to be attached to the mastoid bone, and coupler 60 to be brought into contact with a location in the ossicular chain.

FIG. 6*b* is an enlargement which shows in detail the implanted microphone of FIG. 6*a*. In this figure sensor 50, which is secured to coupler 60, can be seen clearly. In this particular embodiment the end-piece of coupler 602 is shaped like a three-pronged clamp. The advantage of this end-piece shape is that it can be attached by wrapping the three prongs around the head of the hammer. The linear motion of coupler 60 along the axis of cylinder 30 enables the coupler itself to be brought closer to or moved away from the chain of ossicles, and the contact pressure to be modified. By this means an improved coupling can be found. Use of the device does not require the chain of ossicles to be broken. On the contrary, its installation is reversible since, when the microphone has been removed, the auditory system regains its original functionality.

FIG. 7*a* shows a second particular embodiment of microphone 100. The microphone is implanted in the middle ear. Cylindrical sheath 30 can be seen extending from the mastoid bone toward the chain of ossicles. Extending beyond the sheath, in the axis of the cylinder, positioning part 40 and sensor 50 can also be seen. This figure also shows how rake angle 330 of the cylinder enables, concomitantly, the device to be attached to the mastoid bone, and the coupler to be brought into contact with a location in the ossicular chain.

FIG. 7*b* is an enlargement which shows in detail implanted microphone 100 of FIG. 7*a*. In this figure sensor 50, which is secured to coupler 60, can be seen clearly. In this particular embodiment the end-piece of the coupler is shaped like a two-pronged clamp 603. The advantage of this end-piece shape is that it can be attached by wrapping the two prongs around the upward-pointing part of the hammer. The linear motion of coupler 60 along axis 101 of cylinder 30 enables the coupler itself to be brought closer to or moved away from the chain of ossicles, and the contact pressure to be modified. By this means an improved coupling can be found. Use of the device does not require the chain of ossicles to be broken. On the contrary, its installation is reversible since, when the microphone has been removed, the auditory system regains its original functionality.

FIG. 8*a* shows a third particular embodiment of device 100. The microphone is implanted in the middle ear. Cylindrical sheath 30 can be seen extending from the mastoid bone toward the chain of ossicles. Extending beyond the sheath, in the axis of the cylinder, positioning part 40 and sensor 50 can also be seen. This figure also shows how rake angle 330 of the cylinder enables, concomitantly, the device to be attached to the mastoid bone, and the coupler to be brought into contact with a location in the ossicular chain.

FIG. 8*b* is an enlargement which shows in detail the implanted microphone of FIG. 8*a*. In this figure sensor 50, which is secured to coupler 60, can be seen clearly. In this particular embodiment the end-piece of the coupler is shaped like a ball 601. The advantage of this end-piece shape is that it can be in contact by simple pressure with the head of the hammer. The linear motion of coupler 60 along axis 101 of cylinder 30 enables the coupler itself to be brought closer to or moved away from the chain of ossicles, and the contact pressure to be modified. By this means an improved coupling can be found. Use of the device does not require the chain of ossicles to be broken. On the contrary, its installation is reversible since, when the microphone has been removed, the auditory system regains its original functionality.

FIG. 9*a* shows a fourth particular embodiment of device 100. The microphone is implanted in the middle ear. Cylindrical sheath 30 extends from the mastoid bone toward the chain of ossicles. Extending beyond the sheath, in the axis of the cylinder, positioning part 40 and sensor 50 can also be seen. This figure also shows how rake angle 330 of the cylinder enables, concomitantly, the device to be attached to the mastoid bone, and the coupler to be brought into contact with a location in the ossicular chain.

FIG. 9*b* is an enlargement which shows in detail the implanted microphone of FIG. 9*a*. In this figure sensor 50, which is secured to coupler 60, can be seen clearly. In this particular embodiment the end-piece of the coupler is shaped like a point 604. The advantage of this end-piece shape is that it can be in contact by simple pressure with the head of the hammer. The linear motion of coupler 60 along axis 101 of cylinder 30 enables the coupler itself to be brought closer to or moved away from the chain of ossicles, and the contact pressure to be modified. By this means an improved coupling can be found. Use of the device does not require the chain of ossicles to be broken. On the contrary, its installation is reversible since, when the microphone has been removed, the auditory system regains its original functionality.

Advantageously, a positioning system of the ball joint type allows three-dimensional adjustment of coupler 60 relative to the ossicular chain.

FIG. 10 shows a section view of a first embodiment using a positioning system of the ball joint type. According to this embodiment the outer surface of sliding ring 20 is substantially spherical in shape. Cylindrical sheath 30 has a cavity of substantially hemispherical shape able to hold sliding ring 20. Sliding ring 20 and sheath 30 cooperate to allow coupler 60 to rotate through the two angles A1 and A2 in FIG. 10. A cylindrical locking ring 21 with a female spherical end-piece compresses sliding ring 20 and sheath 30, due to the fact that cylindrical locking ring 21 has a male thread, and sheath 30 a female thread. The locking ring includes lugs on the face opposite the sheath, enabling it to be tightened.

According to the embodiment represented in FIG. 10, axial translation of sensor 50 is controlled by means of micrometric screw 10 and spring 51. Said screw 10 is screwed axially into positioning part 40. Spring 51 enables sensor 50 to be moved backwards, whilst holding sensor 50 against micrometric screw 10. In other words, the spring enables screw 10 and sensor 50 to be secured translationally.

FIG. 11*a* shows a section view of a second particular embodiment, for which positioning means of the "ball joint" type allow three-dimensional adjustment of coupler 60 relative to the chain of ossicles.

According to this embodiment, the outer surface of sliding ring 20 is substantially spherical in shape, and cylindrical sheath 30 is, at its end, of a hollow or female hemispherical shape. In other words, cylindrical sheath 30 has a cavity of substantially hemispherical shape, in which sliding ring 20 is positioned. A cylindrical locking ring 21 with a hollow or female hemispherical end-piece enables sliding ring 20 of spherical shape to be held against cylindrical sheath 30. According to this embodiment, sliding ring 21 is screwed in the cylindrical sheath by a thread on cylindrical locking ring 21 and a thread on cylindrical sheath 30.

On the face opposite sliding ring 20 cylindrical locking ring 21 also has means enabling locking ring 21 to be tightened, such as lugs. According to this embodiment, these positioning means enable coupler 60 to have at least 2 degrees of freedom, thereby improving the coupling between coupler 60 and the chain of ossicles. In other words, sliding ring 20 and sheath 30 cooperate to allow coupler 60 to rotate through the two angles A1 and A2 of FIG. 11.

Figure 11B:
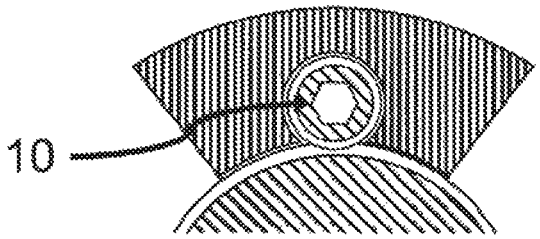

FIGS. 11*a* and 11*b* show a means of adjusting the sensors progression, comprising an adjustment screw 101, screwed into positioning part 40 on the perimeter of sensor 50, such that the threads of adjustment screw 101 and of sensor 50 are tangential, enabling to sensor 50's progress to be adjusted using a helical coupling.

The invention claimed is:

1. An implantable microphone for a middle ear prosthesis including:

an attachment system arranged to be attached to an attachment bone in proximity to an individual's middle ear;

a cylindrical retaining sheath, wherein said cylindrical retaining sheath is arranged to be attached to the attachment bone using the attachment system, and is shaped such that the cylindrical retaining sheath is configured to extend from the attachment bone toward the individual's ossicular chain;

a coupler including a rod and an end-piece shaped such that the coupler is arranged to be brought into contact with at least one point of the individual's ossicular chain in a reversible manner;

a sensor to convert a mechanical signal into an electrical signal, wherein said sensor is secured to the coupler, supported by the cylindrical retaining sheath, and positioned fully in alignment with a longitudinal axis of a cylinder formed by the cylindrical retaining sheath;

a translation system to move the coupler with linear motion along the longitudinal axis of the cylinder, wherein the translation system is contained in the cylindrical retaining sheath, and comprises a positioning part that contains an unthreaded portion into which the sensor is received and a threaded portion into which a micrometric feed screw is inserted.

2. The implantable microphone according to claim 1, wherein the attachment system includes at least one arm, wherein one end of the arm includes at least one position for an attachment screw, and wherein another end supports the cylindrical retaining sheath.

3. The implantable microphone according to claim 1, wherein the translation system includes the micrometric feed screw, a sliding ring and the positioning part, wherein the sliding ring is hollow cylinder, cylindrical and concentric to the cylindrical retaining sheath.

4. The implantable microphone according to claim 3, wherein the cylindrical retaining sheath includes at least one pin and the sliding ring includes at least one recess shaped so as fit on the pin to prevent the ring from rotating around the longitudinal axis of the cylinder, and to prevent the ring from moving along the longitudinal axis of the cylinder, wherein the micrometric screw is installed in an axis of the sliding ring, and prevented from rotating and from moving in linear fashion in the area of a face of the sliding ring.

5. The implantable microphone according to claim 3, wherein the positioning part, the sensor and the coupler are translationally secured to one another, along the longitudinal axis of the cylinder.

6. The implantable microphone according to claim 3, wherein the outer surface of the sliding ring is substantially spherical in shape, and the cylindrical retaining sheath has a cavity of substantially hemispherical shape, wherein the microphone also includes a cylindrical locking ring with a female hemispherical end-piece.

7. The implantable microphone according to claim 1, wherein the sensor is a transducer of the micro-membrane type.

8. The implantable microphone according to claim 1, wherein the end-piece is of spherical shape or has the shape of a two-pronged clamp or of a three-pronged clamp.

9. A method comprising positioning an implantable microphone according to claim 1 in an individual's ear, and optimizing an intensity of the coupling between the sensor and the ossicular chain by an in-ear impedance measurement.

10. A device comprising:

a microphone according to claim 1;

an implant including a main implant body;

a connector with two or three points, wherein the microphone is connected to the implant by the two- or three-point connector.

* * * * *